United States Patent [19]

Sundberg

[11] 4,055,245

[45] Oct. 25, 1977

[54] DEVICE WITH COLLECTING BASKET FOR COLLECTING PRINTED MATTER IN A PILE AND DISCHARGING THE SAME

[75] Inventor: Leif Sundberg, Eksjo, Sweden

[73] Assignee: Wamac AB, Eksjo, Sweden

[21] Appl. No.: 676,356

[22] Filed: Apr. 12, 1976

[30] Foreign Application Priority Data

Apr. 16, 1975 Sweden ..... 7504369

[51] Int. Cl.[2] ..... B65G 57/00

[52] U.S. Cl. ..... 198/422; 198/485; 198/750; 214/6 D; 214/6.5; 271/213

[58] Field of Search ..... 198/422, 485, 600, 601, 198/750, 374; 271/213; 214/6 D, 6 S, 6.5; 93/93 DP

[56] References Cited

U.S. PATENT DOCUMENTS

| | | | |
|---|---|---|---|
| 2,732,067 | 1/1956 | Cunningham et al. | 198/601 |
| 2,970,682 | 2/1961 | Fisk | 198/750 |
| 3,245,557 | 4/1966 | Maramonte et al. | 198/422 |
| 3,532,230 | 10/1970 | Gutberlet et al. | 198/422 |
| 3,595,370 | 7/1971 | Fujishiro | 198/422 |
| 3,599,807 | 8/1971 | Hedrick et al. | 214/6.5 |

*Primary Examiner*—Evon C. Blunk
*Assistant Examiner*—Joseph E. Valenza
*Attorney, Agent, or Firm*—Strauch, Nolan, Neale, Nies & Kurz

[57] ABSTRACT

A device or apparatus for collecting printed matter in a pile and delivering the pile to a conveyor at the same high speed as the output rate of a modern printing machine. A collecting basket can be rotated 180° to enable alternate piling of folded printing matter to keep the piles even. The bottom of the collecting basket is a roller conveyor. To achieve high speed operation, the lateral opening in the collecting basket has two swing gates and the collecting basket is supported on a laterally reciprocable sled. From a starting position, where the basket is in position for collecting newspapers, a motor can move the sled, with the basket, at a sufficiently high speed horizontally through a relatively short distance to a stop position, at which position the lateral opening of the collecting basket is open because of outward swing movement of the two swing gates. The stop position is adjacent a belt conveyor at the same level as the basket bottom roller conveyor. The high speed of the sled, and thus also of the pile of newspaper, gives the pile a kinetic energy and when the sled and thus the basket are stopped the pile moves out along the basket bottom roller conveyor and out onto the belt conveyor which moves in the same direction and at the same speed. The basket can have two side openings each with swing gates and the sled can be moved in either direction to discharge a pile onto one or the other of a pair of belt conveyors at opposite stop positions of the sled.

9 Claims, 4 Drawing Figures

DEVICE WITH COLLECTING BASKET FOR COLLECTING PRINTED MATTER IN A PILE AND DISCHARGING THE SAME

This invention relates to a device with a collecting basket for rapidly collecting in a printing plant printed matter, such as newspapers, in the form of a pile and discharge the pile through a lateral opening in the collecting basket.

It is known to collect printed matter, for example newspapers, in the form of a pile in a stationary basket provided with a lateral opening and thereafter more or less manually to press the pile out through the lateral opening. This requires, however, so much time that the device cannot manage to pile the printed matter in the collecting basket and to discharge the pile at the same rate as modern printing machines to-day produce the printed matter, for example 70–90 thousand copies per hour.

The present invention has the object to produce a device with a collecting basket for collecting printed matter in a pile and discharging the pile of such a kind, that the device is capable of reliable operation at the same high output rate as modern printing machines.

This object is solved with a device having a collecting basket for collecting printed matter, especially newspapers, in the form of a pile and discharging the pile through a lateral opening in the collecting basket, according to the invention thereby, that the collecting basket, as known per se, is provided with an easily movable bottom, for example a roller conveyor with freely rotating rollers and with its transport direction toward the lateral opening in the basket, that the lateral opening can be closed by preferably two mechanically controlled swing gates, and the collecting basket is supported on a sled or the like, which from a starting position, in which the basket is in position for collecting newspapers can be moved mechanically and sufficiently rapidly in horizontal direction through a relatively short distance to a stop position, in which the lateral opening of the collecting basket by outward swing movement of possible gates is open adjacent a per se known conveyor of relatively high speed disposed substantially on the same level as the movable basket bottom, so that the newspaper pile by its own inertia rapidly moves out of the collecting basket and over to the conveyor.

Figure 1:
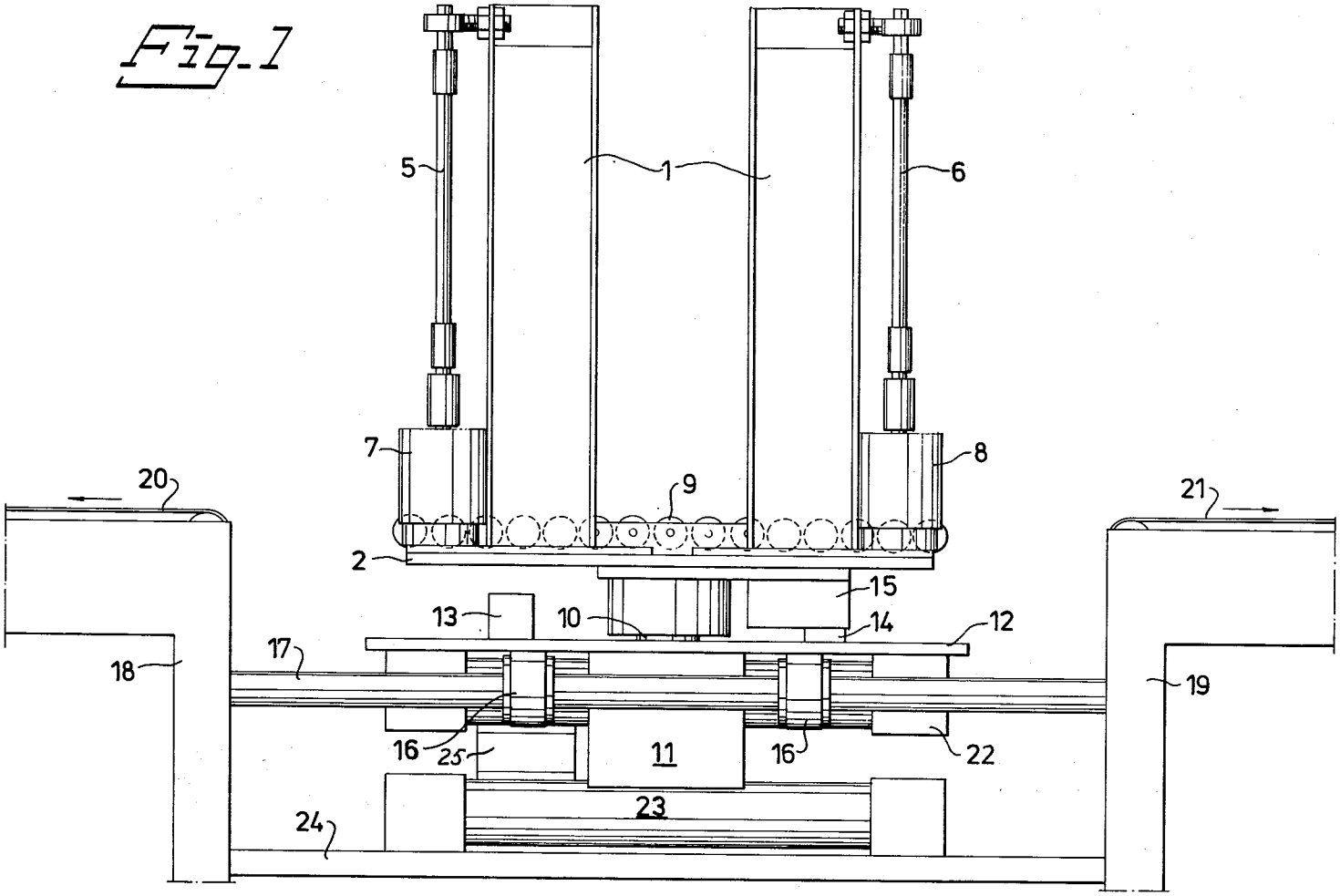
Figure 2:
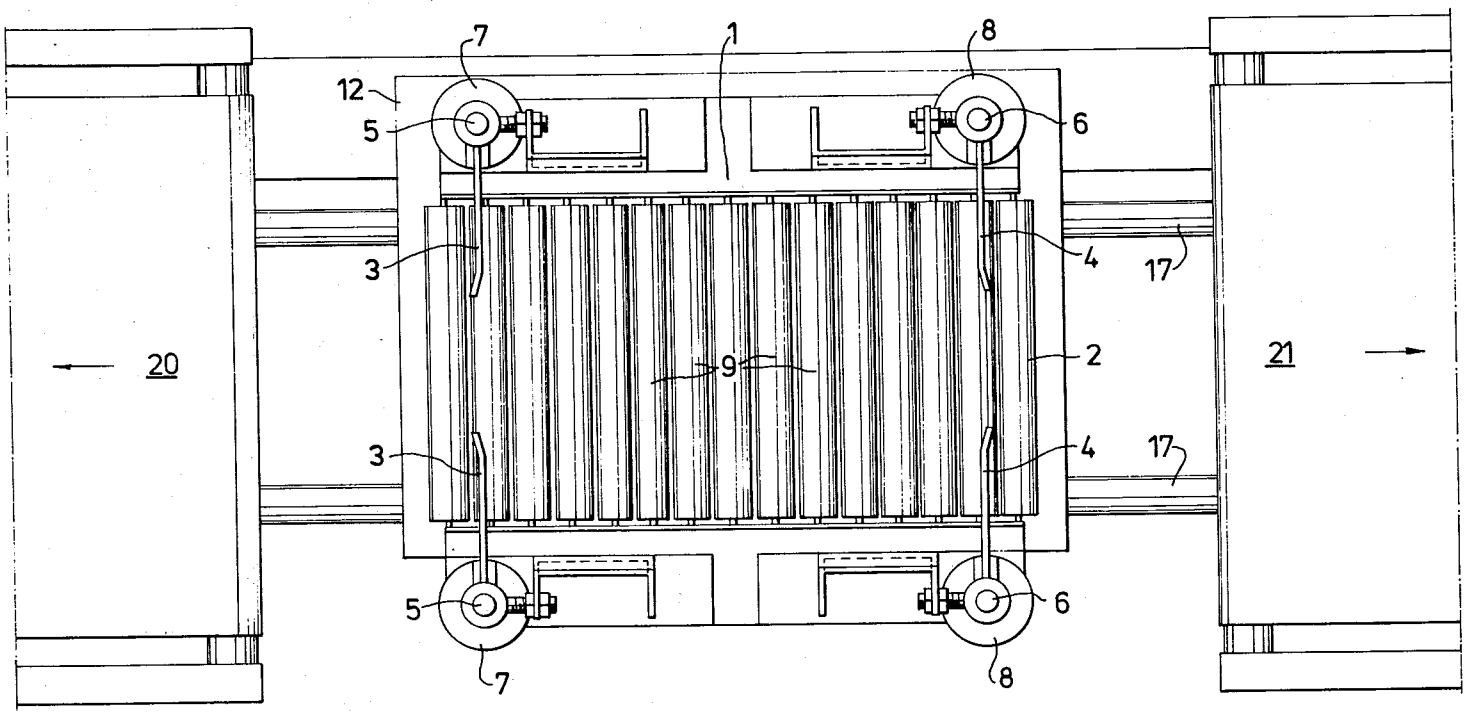
Figure 3:
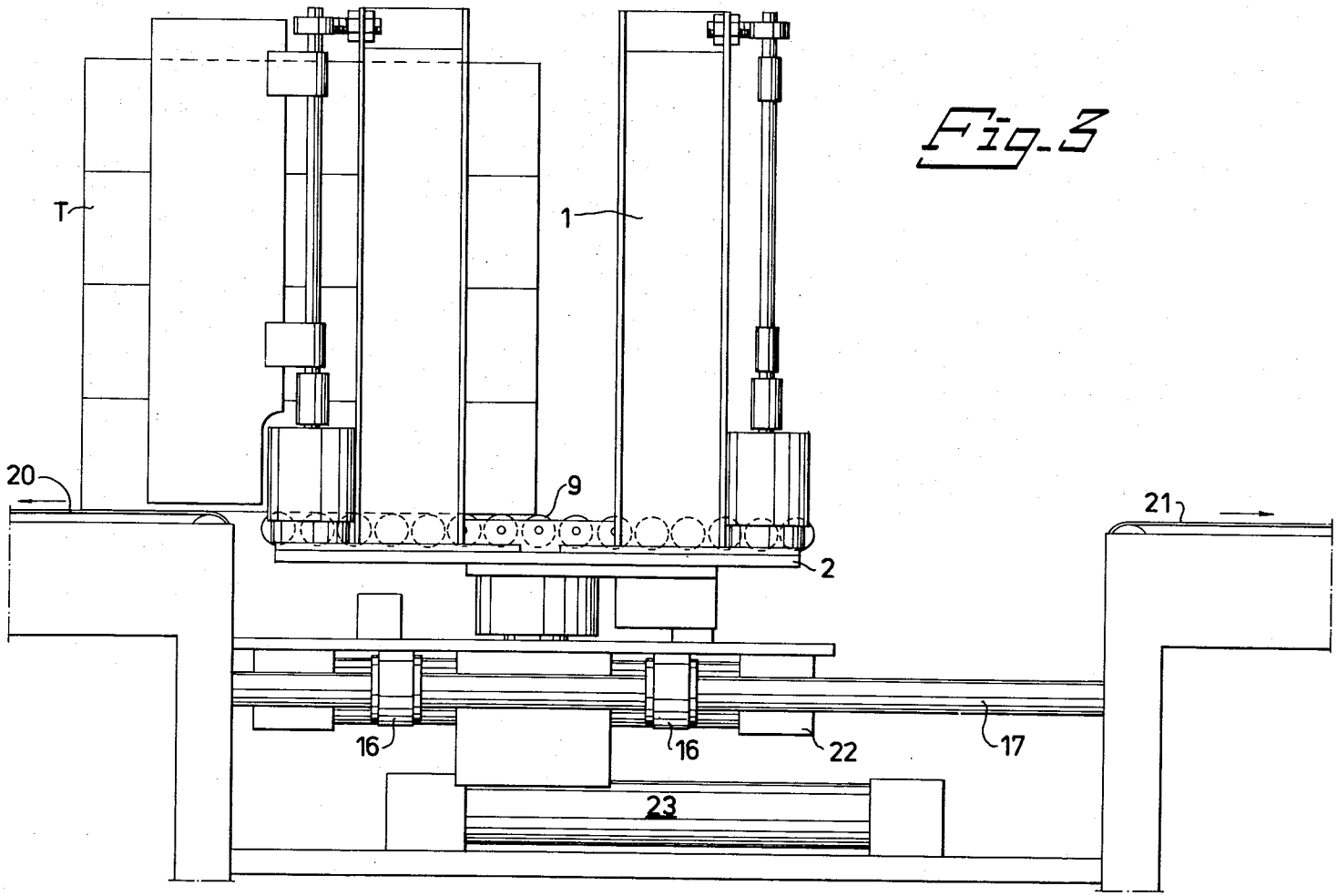
Figure 4:
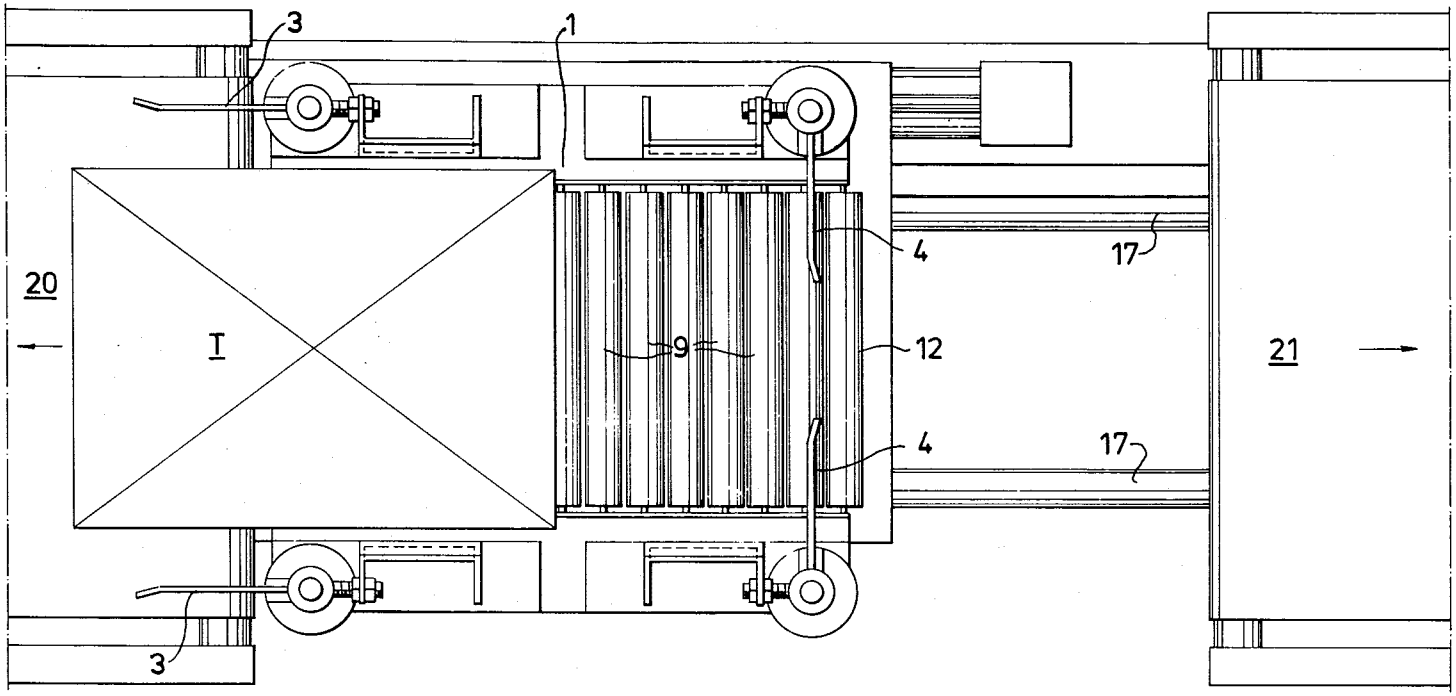

The invention is explained in greater detail with reference to the description of an embodiment shown by way of example in the accompanying drawings, in which FIG. 1 is a lateral view of the device, according to the invention, in the starting position, FIG. 2 is a horizontal view of the device in FIG. 1, FIG. 3 is a lateral view of the device in operation, FIG. 4 is a horizontal view of the device according to FIG. 3.

The device according to the invention as shown in FIGS. 1 and 2, comprises a collecting basket 1, the horizontal sectional shape of which substantially is adapted to the printed matter to be piled and at this embodiment is shown rectangular for the edge-wise piling of newspapers. The basket 1 is mounted on a turntable 2. Two of the opposed sides of the basket 1 consist of two pairs of gates 3,3 and 4,4, at each of which, thus, a lateral opening in the basket is located. The gates are mounted each on a vertical axle 5, 6 outside the basket, which gates are restrictedly rotatable forth and back through one quarter of a revolution by being connected to pressure-medium actuated rotary pistons (not shown) in rotary cylinders 7 and 8, respectively, attached to the turntable 2. A roller conveyor 9 with freely rotating rollers extends between the gates 3,3 and 4,4 as an easily movable bottom in the basket 1.

The turntable 2 with the basket 1 is mounted on a vertical central axle 10, which is connected to a pressure-medium actuated rotary piston (not shown) in a rotary cylinder 11 supported on a sled 12. Two stop shoulders 13 and 14 mounted on the sled 12 approximately diametrically relative to the axle 10 form stop members for a cam 15 projecting downward from the turntable 2 after the turntable and therewith the basket 1 have been rotated through half a revolution. The cam 15 abuts the shoulders 13, 14 in an elastic manner.

The sled 12 rests by means of slide shoes 16 with ball bushings on two horizontal rod-shaped guides 17 between two stands 18 and 19, each comprising a horizontal belt conveyor 20 and 21 substantially on the same level as and aligning with the roller conveyor 9 and with a transport direction indicated by an arrow. On the lower surface of the sled an elongated cylinder 22 in parallel with the guides 17 is attached, and below and in parallel with said cylinder 22 a second cylinder 23 is mounted stationary on a support 24. In each of said cylinders 22, 23 a piston (not shown) is actuated by a pressure-medium, e.g. air. The pistons in the cylinders 22, 23 are interconnected by a connection 25 each extending through a slot in the wall of the cylinders and in the longitudinal direction of the cylinders to the right from the position of the connection 25 shown in FIG. 1.

The device according to the invention operates as follows in order to collect in printing plants, especially newspaper printing plants, a number of printed matter, e.g. newspapers, and thereafter discharge the same. The basket 1 is then positioned in the starting position shown in FIGS. 1 and 2 centrally between the conveyors 20, 21 and with closed gates 3,3 and 4,4. The printed matter, which in this case is assumed to consist of folded newspapers facing with their back in the same direction, is inserted from above into the basket 1 by being dropped therein by means (not shown). When a certain number of newspapers, for example 20 copies, have been dropped into the basket, usually as a bundle, the pressure medium in the rotary cylinder 11 causes the rotary piston and therewith the central axle 10 and turntable 2 with the basket to rotate. This rotation is limited to half a revolution and stopped elastically by the cam 15 abutting the shoulder 13 or 14. The next bundle of newspapers remains then lying with the back in the direction opposite to that of the backs of the newspapers dropped first whereby the resulting newspaper pile will be uniform and stable. This reciprocatory rotation of the basket in connection with the deposition of a newspaper bundle is repeated until a newspaper pile T with predetermined height is obtained in the basket, see FIGS. 3 and 4. The newspaper pile T then rests on the roller conveyor 9 in the basket 1.

By supply of pressure medium, for example to the cylinder 22, the cylinder 22 and the sled 12, which is rigidly connected therewith and guided by the slide shoes 16, with the basket 1 is driven rapidly to the left in FIG. 1 and stopped in the position adjacent the conveyor 20 shown in FIGS. 3 and 4, preferably thereby that the sled 12 abuts a buffer means (not shown) on the stand 15. During said movement of the basket 1 the gates 4,4 are closed, but the gates 3,3 are swung through one quarter of a revolution to open position by means of pressure medium in the rotary cylinders 7. When the basket 1 as mentioned is suddenly stopped, the newspaper pile T by its own inertia or by kinetic energy received continues from the roller conveyor 9 over to the conveyor 20, which has the same transport direction and about the same speed as the newspaper pile, so that the pile even during the transfer from the roller conveyor to the conveyor has a sufficiently firm standing position and does not turn over. The sled 12 with the basket 1 thereafter returns to the starting position while closing the gates 3,3, and the basket is filled with the next bundle of newspapers as described. The basket 1 then is moved this time to the right, if desired, so that the newspaper pile is transferred to the conveyor 21.

The device according to the invention provides from a function point of view particularly the advantages, that the newspapers rapidly and handily can be piled in the form of a stable newspaper pile and thereafter be thrown out without loosing the balance. If the basket would be stationary and provided with a mechanically operated conveyor at the bottom, the relatively high pile would tilt upon the necessary rapid starting of the conveyor at the basket bottom. Even if this tilting could be prevented by means of a movable arm supporting the rear edge of the pile and following with the pile, this would require a complicated arrangement, the more so as it must be possible to discharge the pile in one or the other direction. The device according to the invention, further, has a speed sufficient for serving a modern printing press with an output of 70–90 thousand copies per hour, i.e. about 20–25 copies per second. As the basket after the collection of preferably 20 newspapers is turned, the turning of the basket takes place during about 1 second, and also the discharge of the newspaper pile takes place during such a short period in order not to obstruct the supply of newspapers. The transfer of a newspaper pile alternatingly to the two conveyors further implies, that each conveyor has sufficient time for transporting away its newspaper pile.

The invention is not restricted to the embodiment described and shown in the drawings, but can be modified within the scope of the invention. The basket, for example, may have only one discharge opening with or without gates and may be movable only in one direction for discharging a pile to a single conveyor. The movable basket bottom may consist of easy-running carrier members of different kind, e.g. an endless belt conveyor, which when being operated mechanically starts just when the movement of the basket has been stopped and then assists in discharging the pile. The conveyors for receiving the pile may be designed as so-called accumulation conveyors formed by freely running rollers on moving chains. The sled may have the form of a carriage with wheels or rollers on rails. The rotary cylinders for rotating the gates may be replaced by guide bars, which during the movement of the basket by forced control cause the gates to assume open or closed position. The drive means for moving the sled can be of different design.

I claim:

1. A device with a collecting basket for collecting printed matter, particularly newspapers, in the form of a pile and for discharging the pile through a lateral opening in the collecting basket, the bottom of said collecting basket comprising a freely movable conveyor having its direction of conveying movement aligned with the lateral opening in the basket, said device being characterized in that: said basket includes two mechanically controlled outwardly movable swing gates adjacent said lateral opening for selectively closing said opening and means connected to said gates for selective opening and closing of said gates; a laterally reciprocable sled means; means mounting said basket on said sled means for reciprocation therewith; power means connected to said sled means to reciprocate said sled means and basket laterally in a direction aligned with the direction of free movement of the basket bottom conveyor from a starting position, where said basket is positioned with the swing gates closed for collecting the printed matter, through a relatively short distance to a stop position and in which stop position the said swing gates are in an open condition; and a horizontal conveyor located with its input adjacent said stop position at substantially the same level as said basket bottom conveyor, so that a pile of printed matter, carried by said basket during lateral reciprocation of the sled means from the start position to the stop position, will by its own inertia move along the basket bottom conveyor out through the lateral opening and over onto the horizontal conveyor.

2. A device as defined in claim 1, wherein said basket bottom conveyor is a roller conveyor with freely rotating rollers.

3. A device as defined in claim 1, wherein said horizontal conveyor is a power operated belt conveyor moving in the same direction and at substantially the same speed as the movement and speed of the printed material moving from said basket under its own inertia.

4. A device as defined in claim 1, wherein the means mounting said collecting basket has a rotary power means which enables pivotal movement of said basket on said sled in steps through 180° about a vertical central axis, whereby, in the start position, said basket can be rotated through one half of a revolution forth and back about the vertical central axis.

5. A device as defined in claim 4, wherein said means mounting said collecting basket on said sled means comprises a turntable supporting said basket, a central axle depending from and secured to said turntable and a rotary fluid pressure motor mounted on said sled means and having a rotary output element secured to rotate said axle; and cooperative abutment stop means secured to said turntable and said sled means provide limit stops for the 180° back and forth pivotal movement of said basket.

6. A device as defined in claim 1, characterized in that said swing gates comprise a pair of co-operating vertically disposed gate members, each of which includes and is supported by a vertical axle pivotally mounted on said basket for pivotal movement through substantially one quarter of a revolution, and said means for selectively opening and closing said gates are rotary fluid pressure motors on said sled means and having outputs connected respectively to said axles.

7. A device as defined in claim 1 in which said collecting basket in addition to said lateral opening has a second lateral opening opposed thereto, characterized in that said second lateral opening is provided with mechanically controlled gates, the movable basket bottom conveyor has its transport direction aligned with the opposed lateral openings, and said collecting basket, from its said starting position, can mechanically be moved rapidly through a relatively short horizontal distance to a second stop position, in which said second lateral opening is located adjacent a second horizontal conveyor.

8. A device as defined in claim 7, wherein: a support means is provided with a base under said sled means and opposed end stands adjacent said two horizontal conveyors; at least two horizontal rod-shaped guides are fixedly secured to said support means and extend along the path of travel of said sled means to said opposed end stands; said sled means include slide shoes with bushings engaged on and slidable along said rods between said starting position midway between said end stands and stop positions adjacent each said end stand; and said power means for reciprocating said sled means comprises two parallel reciprocating fluid pressure piston cylinder motors, a first of which having its cylinder secured to said sled means and a connection means connected to its piston and depending toward and connected to the piston of said second reciprocating fluid pressure piston cylinder motor; and means fixedly securing the cylinder of said second fluid pressure piston cylinder motor to said support means.

9. A device as defined in claim 1, wherein: a support means is provided with a base under said sled means; at least two horizontal rod-shaped guides are fixedly secured to said support means and extend along the path of travel of said sled means to adjacent said horizontal conveyor; said sled means include slide shoes with bushings engaged on and slidable along said rods; and said power means for reciprocating said sled means is a reciprocating fluid pressure piston cylinder motor having its cylinder secured to said sled means and a connection means from its piston to said support means.

* * * * *